US005623893A

United States Patent [19]

Bartz et al.

[11] Patent Number: 5,623,893

[45] Date of Patent: Apr. 29, 1997

[54] ADJUSTABLE FAN SHROUD ARRANGEMENT

[75] Inventors: John C. Bartz, Fuquay-Varina, N.C.; Brian S. Howard; Randall G. Peck, both of Peoria, Ill.

[73] Assignee: Caterpillar Inc., Peoria, Ill.

[21] Appl. No.: 650,279

[22] Filed: May 20, 1996

[51] Int. Cl.[6] ..... F01P 7/10

[52] U.S. Cl. ..... 123/41.49; 415/126; 165/DIG. 311

[58] Field of Search ..... 123/41.49, 41.01; 415/126; 165/DIG. 311

[56] References Cited

U.S. PATENT DOCUMENTS

| | | | |
|---|---|---|---|
| D. 272,182 | 1/1884 | Fowler et al. | D23/164 |
| 3,794,001 | 2/1974 | Birch et al. | 123/41.05 |
| 3,980,132 | 9/1976 | Mitchell et al. | 165/76 |
| 4,018,297 | 4/1977 | Haupt | 180/54 |
| 4,213,426 | 7/1980 | Longhouse | 123/41.49 |
| 4,522,160 | 6/1985 | Speers et al. | 123/41.49 |
| 4,724,747 | 2/1988 | Sturm et al. | 98/1 |

*Primary Examiner*—Noah P. Kamen
*Attorney, Agent, or Firm*—Alan J. Hickman

[57] ABSTRACT

A first adjustment arrangement facilitates adjustment of a plenum in a first direction of movement relative to a fan axis and a second adjustment arrangement facilitates adjustment of a shroud in a second direction of movement transverse the first direction of movement. A plurality of fasteners secures the adjusted plenum to the radiator and a plurality of fasteners secures the adjusted shroud to the plenum. A pilot arrangement supports and guides the shroud on the plenum during adjustment and maintains the shroud in position during fastening of the shroud to the plenum.

17 Claims, 3 Drawing Sheets

ADJUSTABLE FAN SHROUD ARRANGEMENT

TECHNICAL FIELD

This invention relates to a shroud arrangement for a cooling fan and more particularly to a cooling fan shroud arrangement having a relatively adjustable plenum, shroud and radiator.

BACKGROUND ART

Construction machines, such as loaders, dozers, material handlers, and the like have work implements, such as buckets, blades, forks and the like movably mounted on the machine frame. An internal combustion engine, which powers the machine and the implements, is resiliently mounted on the frame by engine mounts of a conventional type. The engine is often transversely mounted relative to the direction of machine movement. A cooling system is provided on the machine for cooling the engine. The cooling system includes a radiator and a fan. The radiator is mounted on the frame adjacent an end of the engine and located to one side of the machine. The fan is often located between the end of the engine and the radiator and rotatively driven by the engine. The fan induces cooling air flow to pass through the core of the radiator for engine cooling purposes.

In construction machines, such as discussed above, it is a common practice to drive the machine, particularly the work implement mounted thereon, into the material so that the work implement may be loaded. Impact between the implement and the material causes the transverse mounted engine to rock relative to the frame, in forward and rearward directions, relative to the direction of movement of the machine. Since the fan is connected to the engine, this movement results in relative movement between the fan blade and radiator. In applications where a shroud for directing air flow is provided, this movement results in interference between the fan blades and surrounding shroud. This interference results in fouling of the fan blades and damage to the shroud.

The location of the centerline of the fan relative to the center of the opening in the shroud are ideally aligned. However, in practice, due to design and manufacturing tolerance stack up alignment seldom occurs. In a longitudinally oriented engine application this misalignment maybe acceptable as clearance between the shroud and fan blade tips is adequate to accommodate the maximum amount of misalignment. However, in transversely mounted machine applications, such misalignment is not acceptable. Under the dynamics of machine operation, the combination of rocking movement of the transversely mounted engine and misalignment of the engine and shroud causes fan blade and shroud interference.

It is desirable to maintain the amount of clearance between the fan blade tips and the shroud within a preselected tolerance range in order to maximize cooling efficiency and minimize noise. Unnecessarily, increasing the clearance between the fan and the shroud to accommodate misalignment and engine rocking is not acceptable as it sacrifices efficiency and noise abatement.

The present invention is directed to overcoming one or more of the problems set forth above.

DISCLOSURE OF THE INVENTION

In one aspect of the present invention, an adjustable fan shroud arrangement is provided for a frame mounted transverse engine having a radiator and a fan having blades for moving cooling air through the radiator. A pair of spaced apart plenum mounting flange portions is connected to the radiator. A plenum includes a plurality of sides, a pair of spaced apart radiator mounting flange portions connected to opposite ones of the sides, and a supporting portion having an opening centrally disposed therethrough. The supporting portion is connected to each of the sides and the opening is of a predetermined size sufficient to receive said fan blades. A shroud having an opening of a predetermined size sufficient to receive the fan blades is disposed through the shroud is provided. A first plurality of fasteners connects the pair of spaced apart plenum mounting flange portions to the pair of radiator mounting flange portions. A second plurality of fasteners connects the shroud to the supporting portion of said plenum. A first means enables adjustable movement of the plenum relative to the plenum mounting flange portions in directions along a first line of movement and a second means enables adjustable movement of the shroud relative to the supporting portion in directions along a second line of movement transverse the first line of movement.

In another aspect of the present invention, an adjustable fan shroud arrangement for a construction machine has a longitudinally oriented frame, an internal combustion engine, and a plurality of engine mounts resiliently connecting a block of the engine transversely to the frame. The engine mounts maintain the engine for limited movement in directions longitudinal of the frame. A fan having an axis of rotation and a plurality of blades connected to a hub is rotatively connected to a first end of the engine block. The axis of rotation is oriented transversely relative to the frame. A radiator is connected to the frame at a location on the frame adjacent the fan. A core of the radiator is oriented substantially normal to the axis of rotation and is adapted to pass fan induced cooling air flow. A plenum has a plurality of sides and a supporting portion. The supporting portion has an opening centrally disposed therethrough. The supporting portion is connected to each of the sides and the opening is of a predetermined size sufficient to receive the fan blades. A first adjustment means maintains the plenum for adjustable movement in directions along a first line of movement relative to the radiator to a first position measured along the first line of movement at which a predetermined tip clearance between the fan blades and the opening is obtained. A second adjustment means maintains the shroud for adjustable movement relative to the supporting portion in directions along a second line of movement transverse the first line of movement to a second position measured along the second line of movement at which a predetermined tip clearance between the fan blades and the opening in the shroud is obtained. The tip clearance permits a predetermined amount of movement of the engine mounted fan in directions transversely relative to the axis of rotation of the fan without resulting in interference between the fan blade and shroud. A first fastening means connects the plenum to the radiator and maintains the plenum at the first position. A second fastening means connects the shroud to the supporting portion and maintains the shroud at the second position.

BEST MODE FOR CARRYING OUT THE INVENTION

Figure 1:
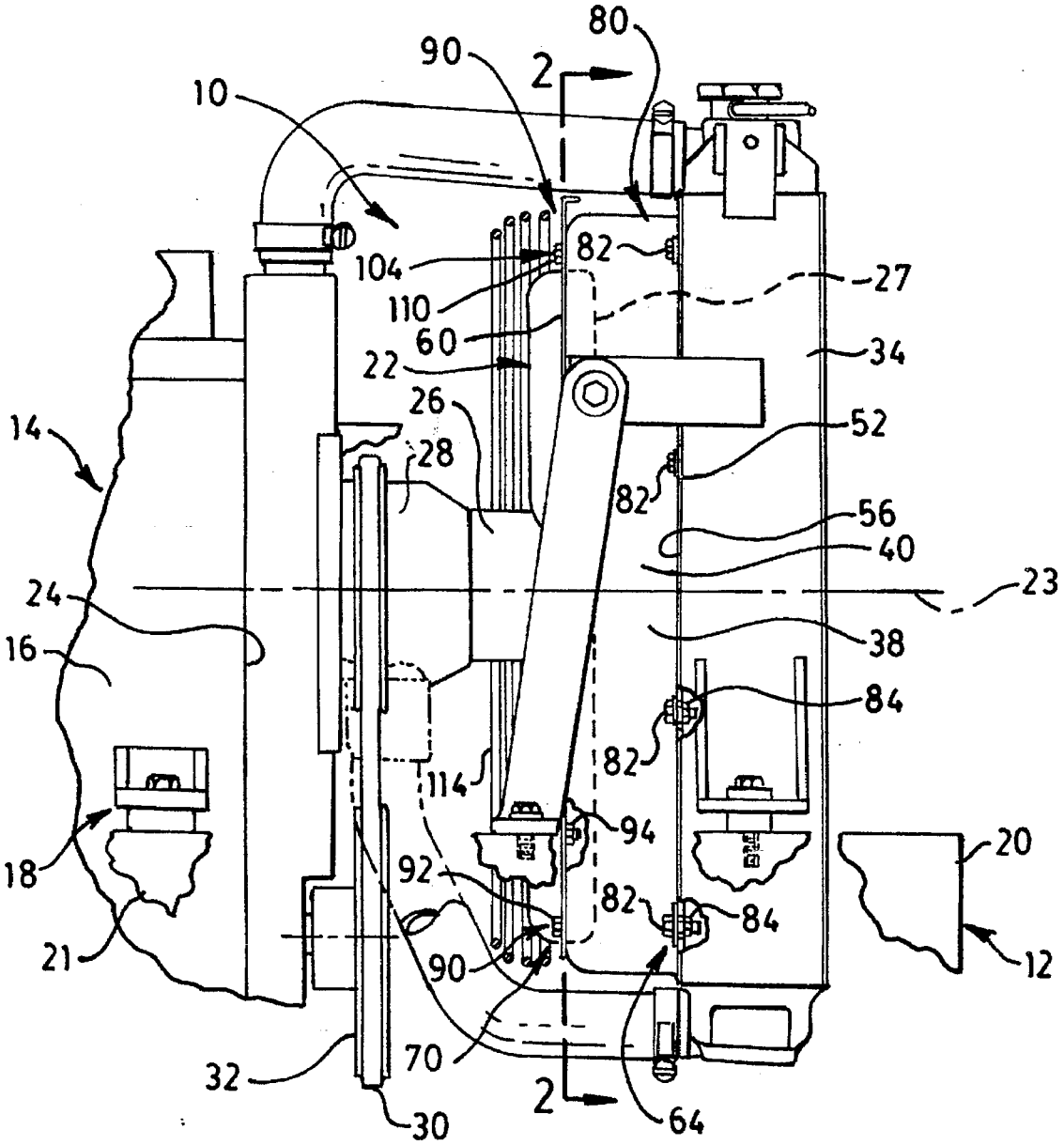
FIG. 1 is a partial diagrammatic view of an embodiment of an adjustable fan shroud arrangement of the present invention in association with a transversely mounted engine, fan, and radiator.

With reference to the drawings, an adjustable fan shroud arrangement 10 is provided for use in a construction machine, such as a wheel loader, back hoe loader, material handler and the like (all not shown). The construction machine has a frame 12 and a transverse mounted internal combustion engine 14. Other transverse mounted engine applications are also within the scope of the present invention. The internal combustion engine 14 has an engine block 16 and is connected to the frame 12 by engine mounts 18 (only one shown). The engine mounts 18, of a conventional type, resiliently connects the engine block 16 to the frame 12 and enables limited movement of the engine 14 relative to the frame 12, as is well known in the art. In the embodiment of the invention shown, the frame 12 has connected spaced rails 20 (one shown) which extend longitudinally in the directions of travel of the machine. The engine 14 is transversely oriented relative to the longitudinal orientation of the frame 12 and connected to a support portion 21 connected to the spaced rails 20. Pertaining to movement of the engine 14 in the longitudinal direction, the engine mounts 18 maintain the engine 14 for a predetermined limited amount of rocking movement in directions longitudinal of the frame 12.

A fan 22 has an axis of rotation 23 which is oriented to extend transversely the frame 12. The fan 22 is rotatively connected to an end 24 of the engine 14. The fan 22 has a hub 26 and a plurality of spaced fan blades 27 connected to the hub 26. In the particular embodiment shown, the hub 26 is connected to a fan drive pulley 28 rotatively connected to the end 24. The fan drive pulley 28 is driven in a conventional manner by a drive belt 30 rotated by an engine driven drive pulley 32.

A radiator 34 is connected to the frame 12 at a location on the frame 12 adjacent the fan 22. A radiator core 36 is oriented substantially normal to the axis of rotation 23. The radiator core 36 is adapted to pass cooling air flow induced by the fan 12 and facilitate heat transfer between the air and coolant flowing through the tubes 37 of the core 36 in a conventional manner. The fan 22 is located between the radiator 34 and the end of the engine block.

Figure 3:
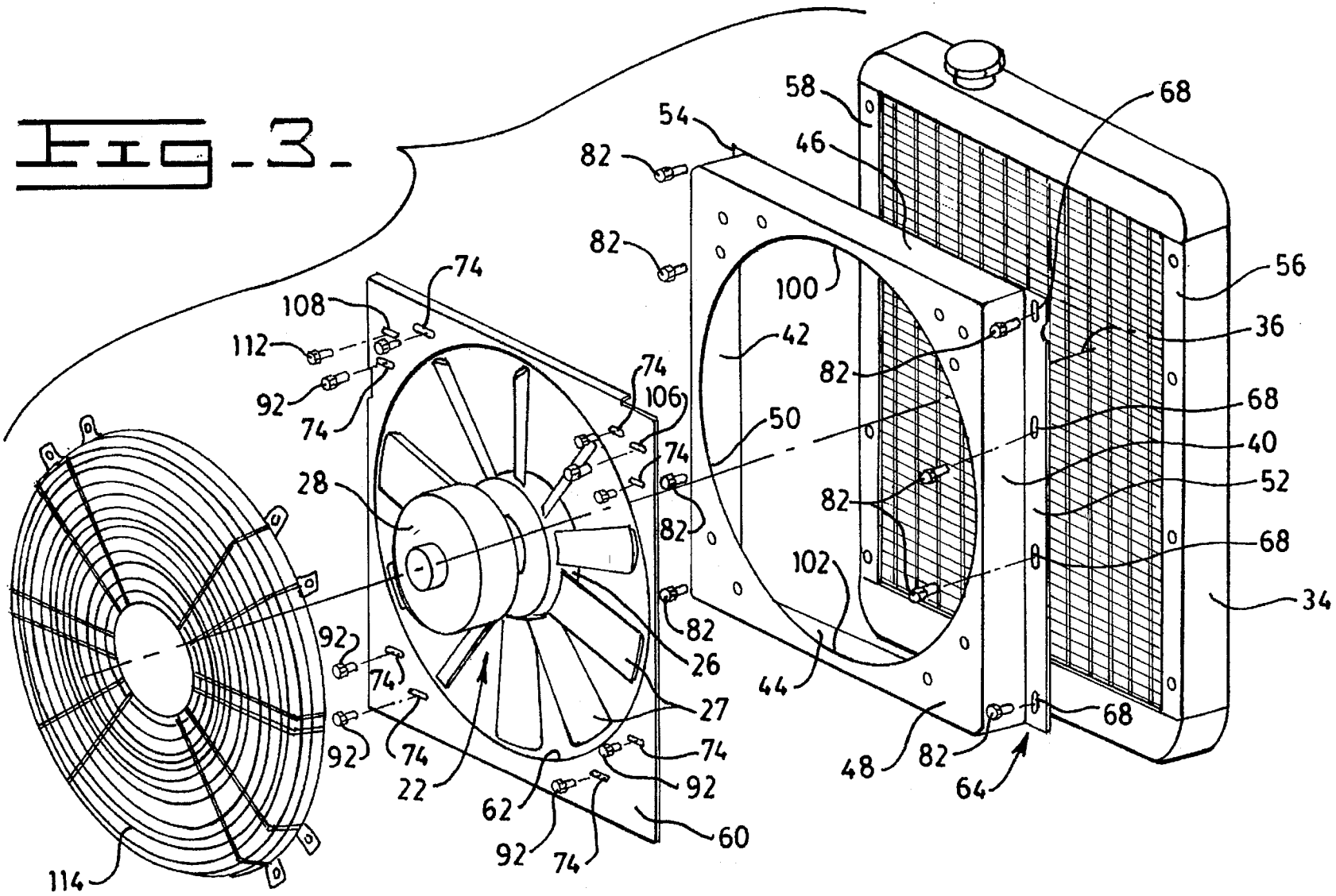
FIG. 3 is a diagrammatic exploded isometric view of the adjustable fan shroud arrangement.

As best seen in FIG. 3, a plenum 38, configured as a box like structure, has a plurality of sides 40, 42, 44, 46 and a supporting portion 48 having an opening 50 centrally disposed therethrough. The supporting portion 48 is connected to each of the sides 40, 42, 44, 46 and the opening 50 is of predetermined size sufficient to receive the fan blades 27. The plenum 38 has a pair of spaced apart radiator mounting flange portions 52, 54 connected to opposite ones 40, 42 of the sides 40, 42, 44, 46. A pair of spaced plenum mounting flange portions 56, 58 are connected to the radiator at opposite sides of the radiator. The plenum mounting flange portions 56, 58 facilitate connection of the radiator mounting flange portions 52, 54. This will be subsequently discussed in greater detail.

A shroud 60 has an opening 62 of a predetermined size disposed therethrough. The opening 62 is of a predetermined size sufficient to receive the fan blades 27.

A first adjustment means 64 is provided for maintaining the plenum for adjustable movement in directions along a first line 66 of movement relative to the radiator 34 (and axis of rotation 36) to a first position measured along the first line of movement at which a predetermined tip clearance $T_1$ between the fan blades 27 and the opening 50 is obtained. The tip clearance $T_1$, is measured along the first line 66.

A second adjustment means 70 is provided for maintaining the shroud 60 for adjustable movement relative to the supporting portion 48 in directions along a second line 72 of movement transverse the first line of movement 66 to a second position measured along said second line 72 of movement at which a predetermined tip clearance $T_2$ between the fan blades 27 and the opening 62 in the shroud 60 is obtained. This tip clearance permits a predetermined amount of rocking movement of the engine mounted fan 22 on the engine mounts 18 in directions transverse the axis of rotation 23 without resulting in interference between the fan blades 27 shroud 60. It is to be noted that the tip clearances between the shroud 60 and fan blades 27 is preferably kept at a minimum in order to minimize noise and maximize efficiency.

A first fastening means 80 connects the plenum 38 to the radiator 34 and maintains the plenum 38 at the first position and a second fastening means 90 connects the shroud 60 to the supporting portion 48 and maintains the shroud 60 at the second position. In particular, the first fastening means 80 includes a first plurality of threaded fasteners 82 releasably connects the pair of spaced apart plenum mounting flange portions 56, 58 to the pair of radiator mounting flange portions 52, 54. A second plurality of threaded fasteners 92 releasably connects the shroud 60 to the supporting portion 48 of the plenum 38. The first plurality of threaded fasteners 82 threadably engages a first plurality of weld nuts 84 attached to the plenum mounting flange portions 54,56 and the second plurality of threaded fasteners 92 threadably engages a second plurality of weld nuts 94 attached to the supporting portion 48 of the plenum 38. The first threaded fasteners 82 urge the pair of spaced apart plenum mounting flange portions 54, 56 into clamping engagement with the radiator 34 and the second threaded fasteners 92 urge the shroud 60 into clamping engagement with the supporting portion 48.

The first adjustment means 64 includes a plurality of spaced apart first elongated slots 68 disposed in the radiator mounting flange portions 52, 54 and about the plurality of first fasteners 82. The first elongated slots 68 are elongate in the direction of the first line 66 of movement and have a predetermined length sufficient to allow adequate movement (elevational) in directions along the first line 66 of movement. The length of the first elongated slots 68 is based on the stack up of tolerances between the axis of rotation 23 of the fan 22, the opening 50 in the plenum 38, and the required amount of fan tip clearance. This stack up in tolerances accounts for engine movement allowed by the engine mounts 18 as measured along the first line 66 of movement.

The second adjustment means 70 includes a plurality of spaced apart second elongated slots 74 disposed in the shroud 60 and about each of the plurality of second fasteners 92. The second elongated slots 74 are elongate in the direction of the second line 72 of movement and have a predetermined length sufficient to allow adequate movement (horizontal) in directions along the second line 72 of movement. The length of the second elongated slots 74 is based on the stack up of tolerances between the axis of rotation 23 of the fan 22 and the opening 62 in the shroud 60. This stack up in tolerances also accommodates any rocking engine movement allowed by the engine mounts 18 in directions as measured along the second line 72 of movement.

Figure 2:
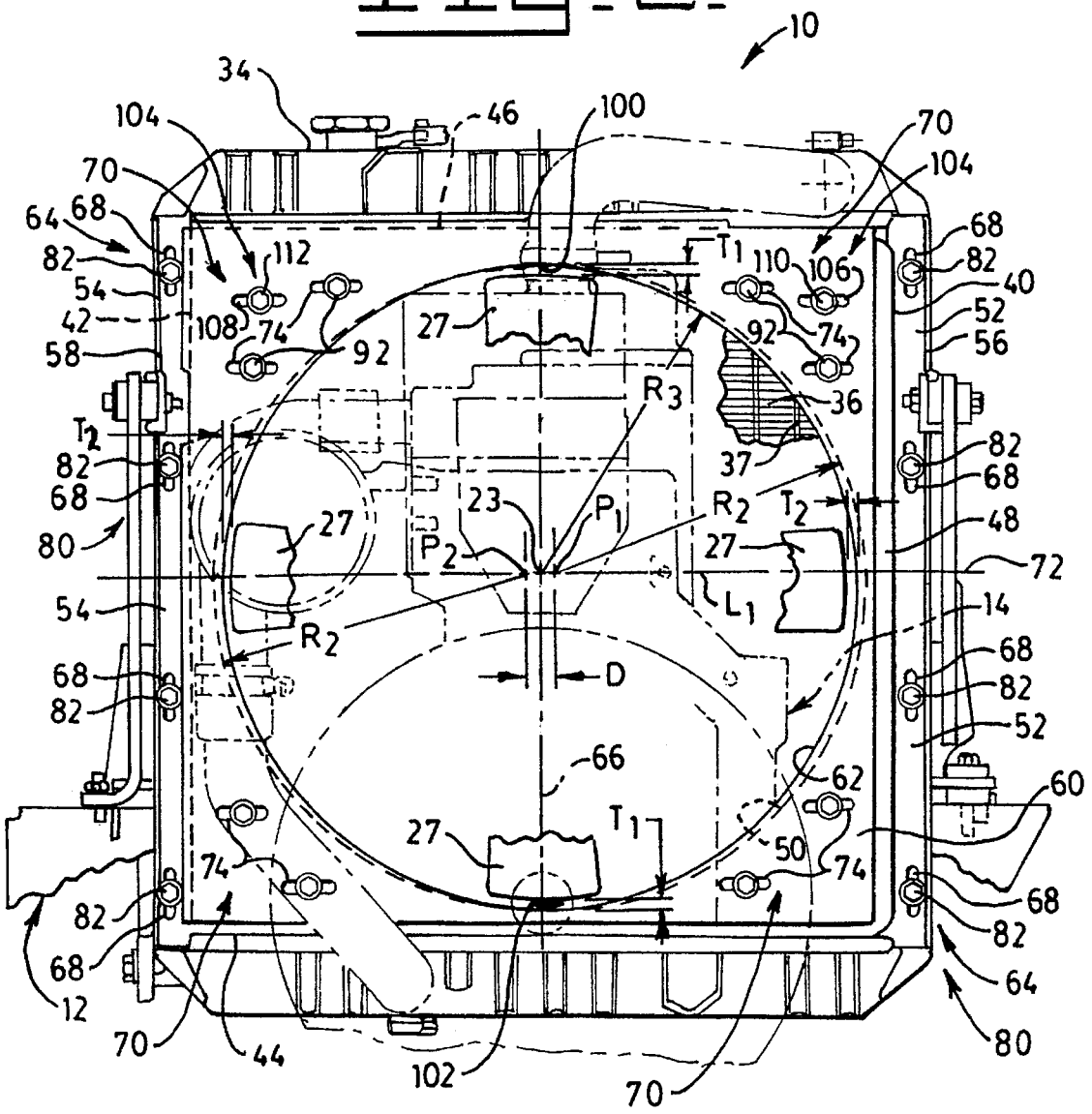
FIG. 2 is a diagrammatic view taken along lines 2—2 of FIG. 1.

As best seen in FIG. 2, the opening 50, disposed in the supporting portion 48 of the plenum 38, is defined by a first radius $R_1$ having a predetermined magnitude and a point of origin $P_1$ lying along a line $L_1$ extending substantially parallel to said second line of movement, a second radius $R_2$ having a predetermined magnitude and a point of origin $P_2$ spaced a preselected distance D from the first point of origin and lying along the line $L_1$, and a pair of spaced tangent side portions 100, 102 tangent to and connecting the first and second radii $R_1$, $R_2$. The magnitudes of the first and second radii $R_1$, $R_2$ are substantially equal and the tangent side portions 100, 102 are substantially parallel to each other. The distance D is of a magnitude sufficient to accommodate at least the amount of rocking movement of the engine in the longitudinal direction and other assembly tolerances.

The opening 62 in the shroud is circular and is defined by a third radius $R_3$. The radius $R_3$ has a predetermined magnitude which is substantially equal to the magnitude of the first and second radii $R_1$, $R_2$ and has a point of origin $P_3$ which lies along line $L_1$. The third radius lies along line $L_1$ and bisects the distance D, between $P_1$ and $P_2$. In the nominal position $P_3$ is at the intersection of lines 66 and 72.

As shown in FIG. 2, the nominally adjusted position of the shroud 60 and plenum 38, the axis of rotation 23 intersects the juncture of intersection of lines 66 and 72. Also, line $L_1$ overlies and is aligned with line 72.

A pilot means 104 adjustably supports the shroud 60 on the plenum 38 and maintains the first, second and third points $P_1$, $P_2$ and $P_3$ substantially on line $L_1$ during adjustable movement of the shroud in directions along the second line of 72 movement. This adjustment is made prior to the second threaded fasteners 92 clamping the shroud 60 to the plenum 38. The pilot means 104 includes a pair of spaced substantially parallel elongated pilot slots 106, 108 disposed in the shroud 60 and a pair of spaced pilot members 110 connected to the supporting portion 48 of the plenum 38. The elongated pilot slots 106, 108 have a preselected length sufficient to permit adequate adjustment movement in the second direction to accommodate tolerance stack up and longitudinal engine movement. The pilot members 110, 112 are disposed in the pilot slots 106, 108, respectively, and support the shroud 60 on the plenum 38. The pilot members 110 guide the shroud 60 and facilitate sliding movement of the shroud 60 relative to the plenum 38 along the second line 72 of movement.

The pilot members 110, 112 are preferably embodied as a pair of pilot fasteners screw threadably connected to the supporting portion 48 and movable from a first position at which said shroud 60 is movable along the second line of movement to a second position at which the shroud 60 is maintained from movement relative to the plenum 38.

A protective shield 114, constructed of spaced wire formed into a domed configuration, is positioned about the cooling fan 22 between the cooling fan 22 and the engine end 24 and connected to the shroud 60 by the second plurality of threaded fasteners 92. The shield 114 is configured to pass cooling air flow and block the entrance of foreign objects of a substantial size.

Industrial Applicability

With reference to the drawings, the adjustable fan shroud arrangement 10, facilitates adjustment of the shroud 60 and plenum 38 in transverse directions relative to the axis of rotation 23 of the fan 22 as measured along first and second lines of movement 66, 72. This reduces the potential for interference between the fan blades 27 and shroud 60 in both static applications and dynamic machine applications.

The plenum 38 is placed on and secured loosely to the radiator 34 by the first fastening means 80. The elongated slots 68, all being oriented in the first direction of movement, permits the plenum to be placed elevationally so that the clearance $T_1$ is obtained, as show in FIG. 2. The first fasteners 82 are then secured until the radiator mounting flange portions 52, 54 are forced into engagement with the respective plenum mounting flanges 56, 58 and thereby clamped together. Because the opening in the plenum, as described above by $R_1$, $R_2$ and the tangent side portions 100, 102, is not round and greater in magnitude along the second line of movement 72 than the first line of movement 66, adjustment of the plenum 38 along the second line of movement 72 is not required. There is adequate clearance, even in worst conditions.

The shroud 60 is subsequently supported on the plenum 38 by the pilot means 104 and moved along the second line of motion 72 until clearance $T_2$ is obtained between the fan blades 27 and the shroud 60 at the opening 62. The pilot members 110, 112 are then secured to hold the shroud 60 in place. The second adjustment means 70, by way of the second elongated slots, permits such adjustable shroud 60 movement. The second fastening means 90 is then used to secure the shroud 60 at this position and retain the shroud at the adjusted position and from subsequent movement along the second line. It is to be mentioned that in some applications, where size and space are not a criteria, it is possible to eliminate the pilot means 104 and utilize the second adjustment and fastening means 70, 90 exclusively.

Should subsequent adjustment along the second line of movement be required over time, one simply loosens the second fastening means 90 and the pilot means 104 and moves the shroud 60 to the desired location relative to the fan blades 27.

Because the circular opening 62 described by $R_3$, is smaller than the opening 50 described above, more efficient and quieter operation is achieved.

Other aspects, objects and advantages of the present invention can be obtained from a study of the drawings, the disclosure and the appended claims.

We claim:

1. An adjustable fan shroud arrangement for a frame mounted transverse engine having a radiator and a fan having blades for moving cooling air through the radiator, comprising:

a pair of spaced apart plenum mounting flange portions connected to said radiator;

a plenum having a plurality of sides, a pair of spaced apart radiator mounting flange portions connected to opposite ones of said sides, a supporting portion having an opening centrally disposed therethrough, said supporting portion being connected to each of said sides, said opening being of a predetermined size sufficient to receive said fan blades;

a shroud having an opening disposed therethrough, said openings being of a predetermined size sufficient to receive said fan blades;

a first plurality of fasteners connecting the pair of spaced apart plenum mounting flange portions to the pair of radiator mounting flange portions, a second plurality of fasteners connecting the shroud to the supporting portion of said plenum;

first means for maintaining adjustable movement of the plenum relative to the plenum mounting flange portions in directions along a first line of movement;

second means for maintaining adjustable movement of the shroud relative to the supporting portion in directions along a second line of movement transverse the first line of movement.

2. An adjustable fan shroud arrangement, as set forth in claim 1, wherein said first means includes a plurality of first elongated slots disposed in said radiator mounting flange portions and about said plurality of first fasteners, said first elongated slots being elongate in the direction of the first line of movement.

3. An adjustable fan shroud arrangement, as set forth in claim 2, wherein said second means includes a plurality of second elongated slots disposed in said shroud and about each of said plurality of second fasteners, said second elongated slots being elongate in the direction of the second line of movement.

4. An adjustable fan shroud arrangement, as set forth in claim 3, wherein said first fasteners urge the pair of spaced apart plenum mounting flange portions into clamping engagement with the pair of radiator mounting flange portions and the second fasteners urge the shroud into clamping engagement with the supporting portion.

5. An adjustable fan shroud arrangement, as set forth in claim 1, wherein said opening in the supporting portion of said plenum is defined by a first radius "$R_1$" having a predetermined magnitude and a point of origin "$P_1$" lying along a line "$L_1$" extending substantially parallel to said second line of movement, a second radius "$R_2$" having a predetermined magnitude and a point of origin "$P_2$" spaced a preselected distance "D" from said first point of origin and lying along said line "$L_1$", and a pair of spaced sides tangent to and connecting said first and second radii "$R_1$", $R_2$", said magnitudes of the first and second radii "$R_1$", $R_2$" being substantially equal.

6. An adjustable fan shroud arrangement, as set forth in claim 5, wherein the opening in said shroud being circular and defined by a third radius "$R_3$" having a predetermined magnitude substantially equal to the magnitude of the first and second radii "$R_1$", $R_2$" and having a point of origin "$P_3$" lying along line "$L_1$".

7. An adjustable fan shroud arrangement, as set forth in claim 6, wherein said second threaded fasteners being adapted to clamp said shroud to said plenum and maintain said shroud from movement relative to said plenum including pilot means for adjustably supporting the shroud on the plenum and maintaining the first, second and third points "$P_1$", "$P_2$", "$P_3$" substantially along said line "$L_1$" during adjustable movement of the shroud in directions along said second line of movement and prior to the second threaded fasteners clamping the shroud to said plenum.

8. An adjustable fan shroud arrangement, as set forth in claim 7, said pilot means including:

a pair of spaced substantially parallel elongated pilot slots disposed in said shroud;

a pair of spaced pilot members connected to the supporting portion of the plenum, said pilot members being disposed in said pilot slots, said pilot members supporting said shroud on the plenum, said pilot members guiding said plenum during sliding movement along said second line of movement.

9. An adjustable fan shroud arrangement for a construction machine having an longitudinally oriented frame, comprising:

an internal combustion engine having an engine block;

a plurality of engine mounts resiliently connecting said engine block to the frame, said engine being transversely oriented relative to said frame, said engine mounts maintaining said engine for limited movement in directions longitudinal of the frame;

a fan having a hub, an axis of rotation, and a plurality of blades connected to said hub, said hub being rotatively connected to an end of the engine and said axis of rotation extending transversely relative to the frame;

a radiator having a core and being connected to the frame at a location on the frame adjacent the fan, said core being oriented substantially normal to the axis of rotation and adapted to pass cooling air flow induced by the fan;

a plenum having a plurality of sides and a supporting portion having an opening centrally disposed therethrough, said supporting portion being connected to each of said sides, said opening being of a predetermined size sufficient to receive said fan blades;

a shroud having an opening disposed therethrough, said opening being of a predetermined size sufficient to receive said fan blades;

first adjustment means for maintaining said plenum for adjustable movement in directions along a first line of movement relative to said radiator to a first position measured along said first line of movement at which a predetermined tip clearance between the fan blades and the opening is obtained;

second adjustment means for maintaining said shroud for adjustable movement relative to said supporting portion in directions along a second line of movement transverse the first line of movement to a second position measured along said second line of movement at which a predetermined tip clearance between the fan blades and the opening in the shroud is obtained, said tip clearance permitting a predetermined amount of movement of the engine mounted fan in directions transversely relative to the axis of rotation without resulting in interference between the fan blade and shroud;

first fastening means for connecting the plenum to the radiator and maintaining said plenum at said first position; and second fastening means for-connecting the shroud to the supporting portion and maintaining said shroud at said second position.

10. An adjustable fan shroud arrangement, as set forth in claim 9, including a pair of spaced apart radiator mounting flange portions connected to opposite ones of said plenum sides, said first fastening means includes a plurality of first threaded fasteners screwthreadably connected to said radiator and said first adjustment means includes a plurality of first elongated slots disposed in the radiator mounting flange portions and about said plurality of first threaded fasteners, said first elongated slots being elongate in the direction of the first line of movement.

11. An adjustable fan shroud arrangement, as set forth in claim 10, wherein said second fastening means includes a plurality of second threaded fasteners screwthreadably connected to said supporting portion and said second adjustment means includes a plurality of second elongated slots disposed in said shroud and about said plurality of second threaded fasteners, said second elongated slots being elongate in the direction of the second line of movement.

12. An adjustable fan shroud arrangement, as set forth in claim 11, wherein said first threaded fasteners urge the pair of spaced apart plenum mounting flange portions into clamping engagement with the radiator and said second threaded fasteners urge the shroud into clamping engagement with the supporting portion.

13. An adjustable fan shroud arrangement, as set forth in claim 9, wherein said opening in the supporting portion of said plenum being defined by a first radius "$R_1$" having a predetermined magnitude and a first point of origin "$P_1$" lying along a line "$L_1$" extending substantially parallel to said second line of movement, a second radius "$R_2$" having a predetermined magnitude and a point of origin "$P_2$" spaced a preselected distance "D" from said first point of origin "$P_1$" and lying along said line "$L_1$", and a pair of spaced sides tangent to and connecting said first and second radii "$R_1$", "$R_2$", said magnitudes of the first and second radii "$R_1$", "$R_2$" being substantially equal.

14. An adjustable fan shroud arrangement, as set forth in claim 13, wherein the opening in said shroud being circular and defined by a third radius "$R_3$" having a predetermined magnitude and having a point of origin "$P_3$" lying along line "$L_1$".

15. An adjustable fan shroud arrangement, as set forth in claim 14, wherein said second threaded fasteners being adapted to clamp said shroud to said plenum and maintain said shroud from movement relative to said plenum including pilot means for adjustably supporting the shroud on the plenum and maintaining the first, second and third points "$P_1$", "$P_2$", "$P_3$" substantially along said line "L1" during adjustable movement of the shroud in directions along said second line of movement and prior to the second threaded fasteners clamping the shroud to said plenum.

16. An adjustable fan shroud arrangement, as set forth in claim 15, wherein said pilot means includes a pair of elongated pilot slots disposed in said shroud and a pair of pilot members connected to the supporting portion of the plenum and disposed in said pilot slots, said pilot members guiding said plenum during sliding movement along said second line of movement.

17. An adjustable fan, as set forth in claim 15, wherein said pilot members include a pair of pilot fasteners screw threadably connected to the supporting portion, said pilot fasteners being threadibly movable from a first position at which said shroud is movable along said second line of movement to a second position at which said shroud is maintained from movement relative to said plenum.

* * * * *